United States Patent [19]

McKenna

[11] 4,333,412

[45] Jun. 8, 1982

[54] SPAR JUNCTURE STRUCTURE FOR WIND PROPELLED CRAFT

[76] Inventor: Quentin M. McKenna, 2 Ave de la Boussole, Port La Galere, Theoule-sur-Mer, 06590, France

[21] Appl. No.: 191,327

[22] Filed: Sep. 26, 1980

[51] Int. Cl.[3] ..... B63B 35/00

[52] U.S. Cl. ..... 114/39; 114/89; 114/61; 114/102; 403/217

[58] Field of Search ..... 403/217, 219, 171, 176; 114/39, 43, 61, 89, 91, 102

[56] References Cited

U.S. PATENT DOCUMENTS

| | | | |
|---|---|---|---|
| 1,642,716 | 9/1927 | Bentzen | 114/102 |
| 3,395,664 | 8/1968 | Greenberg et al. | 114/39 |
| 3,827,206 | 8/1974 | Nierle | 403/219 |
| 3,933,110 | 1/1976 | Jamieson | 114/61 |
| 3,991,694 | 11/1976 | Black | 114/39 |
| 4,149,481 | 4/1979 | Leber | 114/39 |

FOREIGN PATENT DOCUMENTS

| | | | |
|---|---|---|---|
| 2649577 | 5/1978 | Fed. Rep. of Germany | 114/61 |
| 2457212 | 5/1979 | France | 114/39 |

*Primary Examiner*—Trygve M. Blix
*Assistant Examiner*—Thomas J. Brahan
*Attorney, Agent, or Firm*—Gust, Irish, Jeffers & Hoffman

[57] ABSTRACT

A wind propelled craft adapted for movement over water or ice having an equilateral tetrahedral frame comprising three substantially equidistantly spaced support members adapted to engage and be supported on the surface of the water, four substantially rigid spars connected together at a juncture and extending radially outward therefrom such that they are separated from each other by equal angles, and a plurality of equilength stays connected between each of the spars and the other spars at points on the spars substantially equidistant from the juncture so as to form with the spars a frame of substantially equilateral tetrahedral shape. Three of the spars extend laterally and downwardly from the juncture and are connected to the support members by stays with the fourth spar extending upwardly from the juncture. A pair of triangular mainsails are connected to respective pairs of stays extending downwardly from the vertical spar in such a manner that they are capable of being raised and lowered. Two pairs of auxiliary sails are mounted rearwardly of the mainsails. Rudders connected to the three support members, respectively, enable the craft to be steered in the desired direction.

4 Claims, 20 Drawing Figures

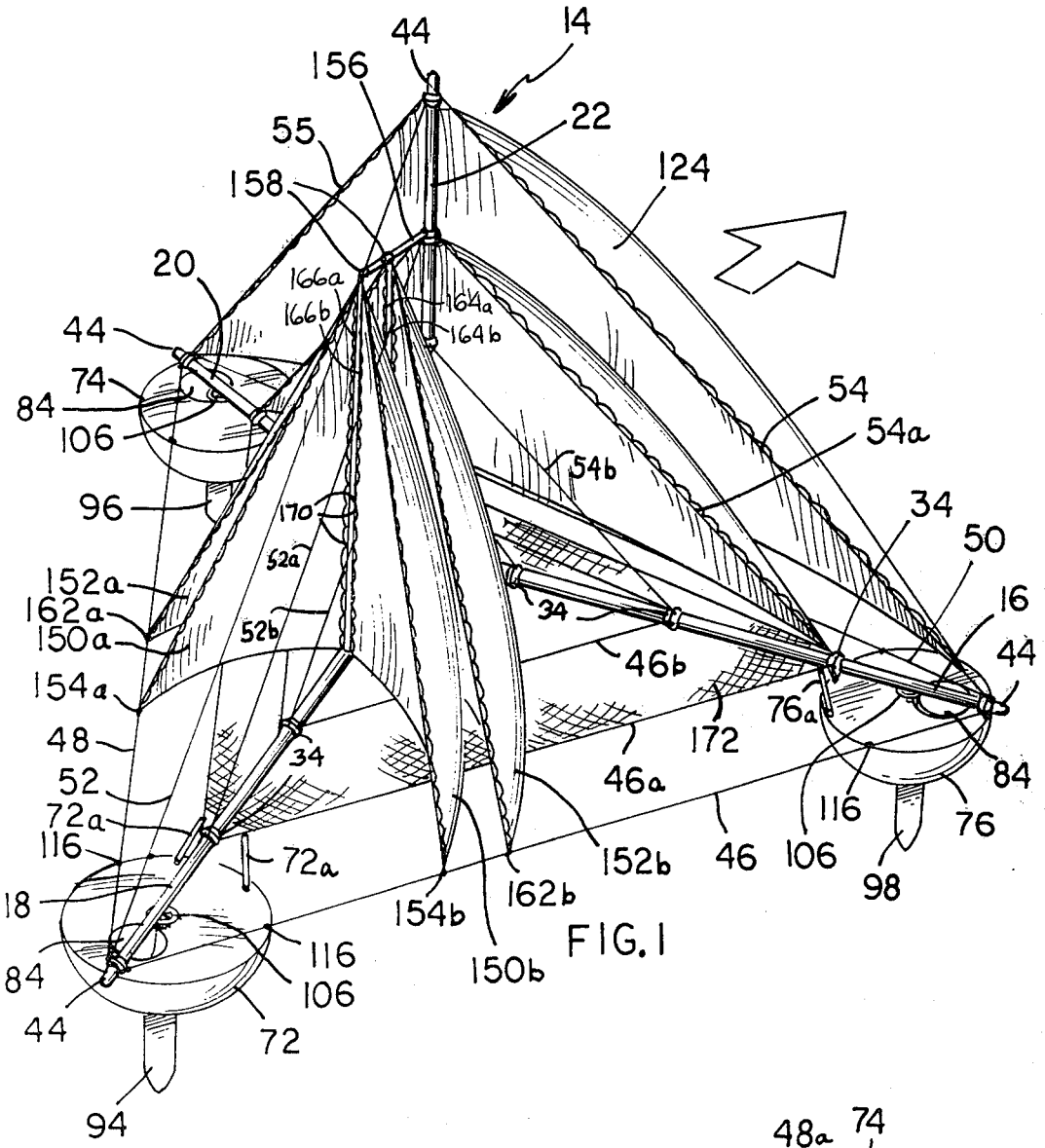
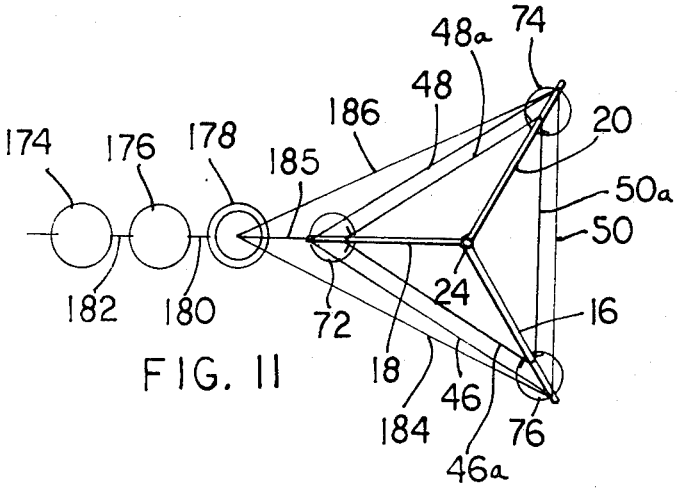
FIG. 11

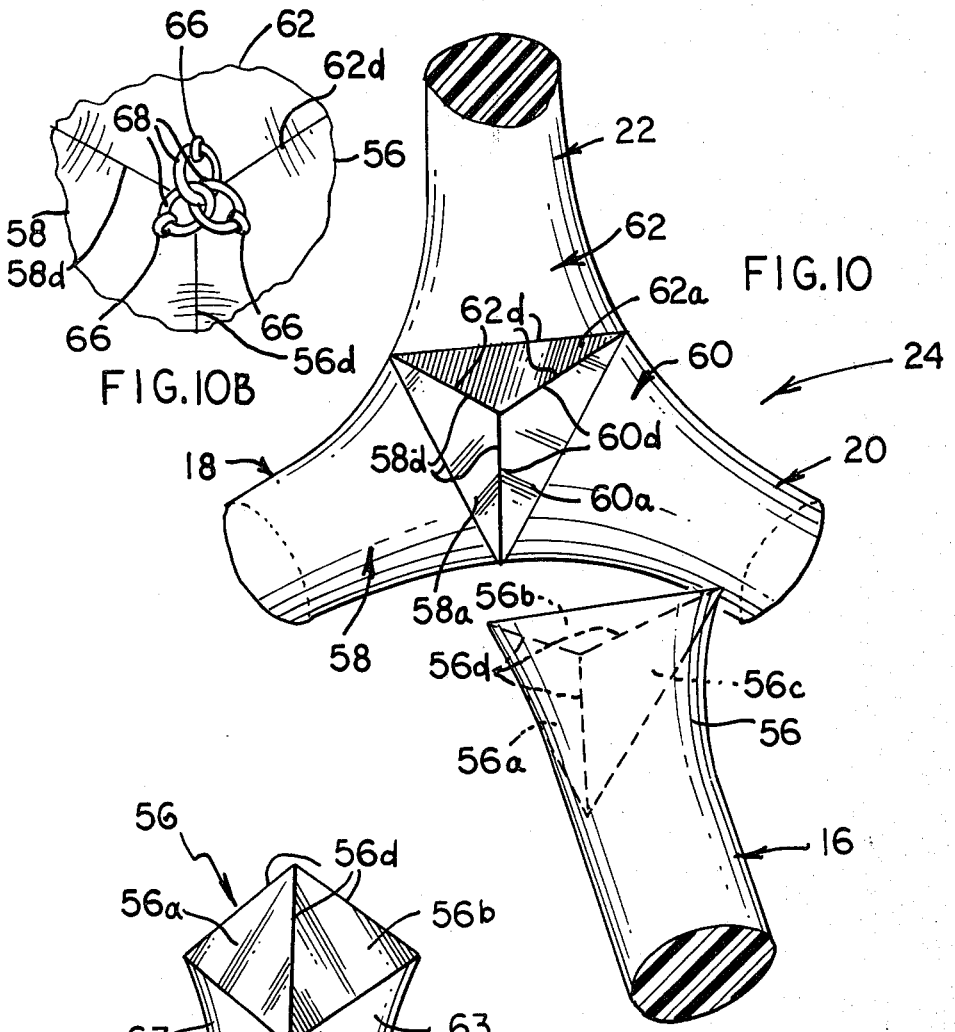
FIG.10B
FIG.10
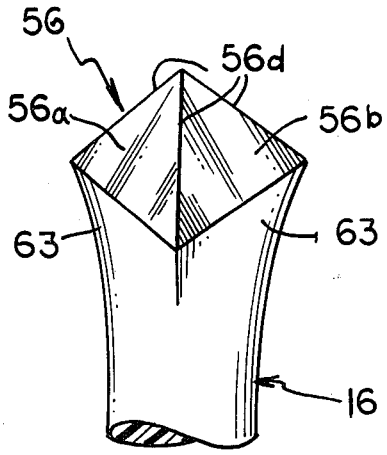
FIG.10A
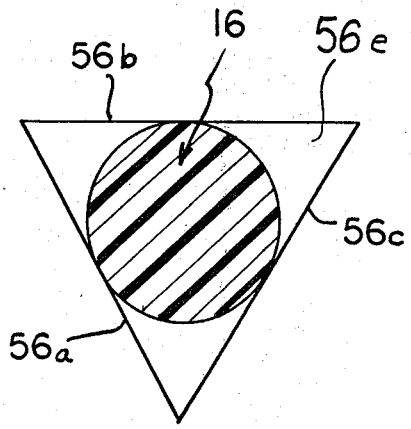
FIG.10D

SPAR JUNCTURE STRUCTURE FOR WIND PROPELLED CRAFT

BACKGROUND OF THE INVENTION

The present invention relates to wind propelled craft adapted for movement over the surface of a medium, such as ice or water.

Sailing vessels have been utilized for water travel from the time of early recorded history, and a great many designs have been developed in order to accomplish the specific objective of the sailing craft, whether it be intended for commercial usage or for pleasure. A great many factors enter into the design of a sailing craft, such as the speed which it can attain in a given wind, its stability in high winds, the amount of sail which it is able to carry in high winds, its durability, and the like.

A common design of sailing craft comprises a single hull, which is generally elongated in shape and provided with a centerboard or keel. One or more masts connected to the hull carry the sails, and in the case of large, ocean going, commercial vessels extensively employed before the advent of steamships, an extremely complex system of masts, yardarms, stays, etc. were required to support and control the amount of sail which was necessary to propel the large hull and cargo load carried therein. A difficulty with a one-hull vessel is that the large contact area between the hull and water results in very substantial frictional drag thereby reducing the speed of the vessel. This drag is further increased by the necessity for having a massive keel in order to prevent overturning of the vessel in high winds.

In order to reduce the frictional drag between the hull and water, multiple hulled vessels, such as catamarans and trimarans, have been developed. In these vessels, the mast or masts and rigging are supported on a plurality of pontoons or floats, which are widely spaced from each other and which have a relatively small wetted surface when compared with a conventional single hulled vessel. Although multi-hulled vessels are capable of much higher speeds than conventional single hulled vessels, they are much more difficult to maneuver, especially when attempting to turn into the wind. Also, because the hulls are interconnected by means of a framework of elongated, tubular members, the vessel is generally not as durable as a single hulled vessel.

In order to overcome the problems and disadvantages of prior art sailing vessel designs, the vessel according to the present invention comprises a equilateral tetrahedral frame connected to three support members adapted to float on the surface of the water, and having a unique arrangement of sails.

One prior art sailing vessel employing a rigid frame which is generally tetrahedral in shape is disclosed in U.S. Pat. No. 3,395,664. In one embodiment, the frame comprises six interconnected tubular members defining a triangular base connected to three buoyant support members, and three triangular sides connected at an apex. In another embodiment, a lower tetrahedral frame made of similar members has a vertical mast connected to the apex thereof and is supported by a plurality of stays connected to the three corners of the triangular base. A problem with the first-discussed embodiment, is that the frame relies for support solely on the six interconnected tubular members, thereby making it unsuitable for operation in high winds or rough seas. In the second embodiment, the mast is merely connected to the tetrahedral frame and does not function as one of the structural members, thereby resulting in an unbalance of forces so as to substantially reduce the durability and overall strength of the vessel.

U.S. Pat. No. 3,991,694 discloses a semi-rigid wind propelled vessel wherein the mast is similarly connected to the apex of a tetrahedral frame and supported by a plurality of stays connected to the corners of the triangular base of the frame. Again, the stresses and forces are unequally distributed, and would not be suitable for oceangoing use, as is the case with the vessel according to the present invention.

SUMMARY OF THE INVENTION

The sailing vessel according to the present invention is designed to be extremely durable and strong such that it is capable of withstanding heavy seas and high winds, which are very often encountered when sailing on the ocean. Furthermore, the design of the vessel enables all of the sails to be unfurled, even in high winds so that maximum speed may be obtained. One of the specific objectives of the invention is to provide a sailing vessel which is designed for trans-oceanic voyages at very high speeds, and capable of towing or carrying larger loads at slower speeds. Of course, the same design would also be applicable to smaller pleasure craft, although such craft would be constructed on a greatly reduced scale.

The basic rigid frame is in the form of an equilateral tetrahedron comprising four substantially rigid struts interconnected together at a juncture and defining equal angles between them. An important aspect of the invention, is that the effective lengths of the struts are equal and are retained in the proper orientation by means of stays connected to the struts at respective points equidistant from the juncture. A frame constructed in this manner has all of the stresses and forces equally distributed among the respective stays and among the respective spars. Furthermore, the center of gravity is at the centroid of the tetrahedron, which is the juncture of the four rigid spars, thereby resulting in a vessel which is extremely stable and not prone to overturning, as would be the case with vessels wherein a tall vertical mast is connected to the apex of the tetrahedral frame.

Connected to the three corners of the triangular base defined by the tetrahedral frame are buoyant support members, each of which includes a movable rudder connected thereto. The rudders are operated in such a manner that the heading and orientation of the vessel can be controlled. If desired, the support elements can be constructed as enclosures for the vessel's crew.

The sails are preferably triangular in shape, with the mainsail being connected by means of slidable connections to the stays extending downwardly from the distal end of the vertical spar thereby resulting in maximum sail exposure without the necessity of extending the sail support structure, as by way of a mast, for example. The mainsail is furled and unfurled by drawing it upwardly and lowering it, respectively, along the stays, as by means of a line and block arrangement. A second mainsail may be mounted in a similar manner to a pair of parallel stays such that it is located immediately behind the first-mentioned mainsail. Smaller, auxiliary sails may be mounted rearwardly by connections between one of the lower spars and the stays located on the rear part of the vessel.

Specifically, the present invention relates to a wind propelled craft adapted to move over a surface, such as water or ice, comprising three substantially equidistantly spaced support members adapted to engage and be supported on the surface, four substantially rigid spars connected together at a juncture and extending radially outward therefrom, each of the spars forming an angle of about 110° with each of the other spars, a plurality of substantially equilength stays connected to and between each one of the spars and the other spars, respectively, the stays being connected to the spars at points substantially equidistant from the juncture so as to form with the spars a frame of substantially equilateral tetrahedral shape. Three of the spars extend laterally and downwardly from the juncture, and the fourth spar extends vertically upward therefrom. The support members are connected to the frame at points near the distal ends of the spars extending laterally and downwardly from the juncture. A sail, which may be triangular in shape, is connected to the frame.

In accordance with one embodiment of the invention, the inner end of each of the spars is formed as a tetrahedron quarter of an equilateral tetrahedron, wherein three of the faces of each of the tetrahedrons fit together with each other so as to form a generally solid assembly at the juncture, which assembly is in the shape of an equilateral tetrahedron. In order to permit the spar and stay structure to be collapsed easily, three of the spars are hingedly connected to the fourth spar along three coplanar edges of the fourth spar.

BRIEF DESCRIPTION OF THE DRAWINGS

FIG. 1 is an isometric view of the wind powered water craft according to the present invention;

FIG. 6 is an elevational view, partially in section, of one of the support members;

FIG. 10 is a partially exploded, isometric view of the juncture of the spars;

FIG. 10A is an isometric view of the end of one of the spars;

FIG. 10B is a detail of the interconnected rings;

FIG. 10D is a sectional view taken along line 10D—10D of FIG. 10C;

FIG. 11 is a diagrammatic view of the vessel configured to tow cargo pods;

DETAILED DESCRIPTION

Figure 8:
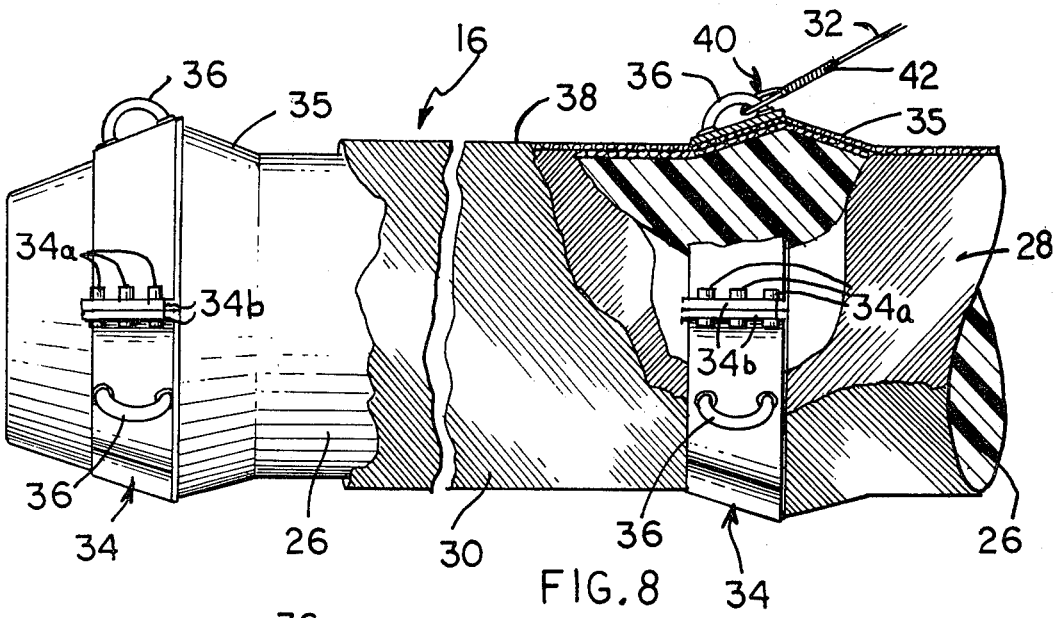
FIG. 8 is an enlarged, fragmentary view of one of the spars with a portion thereof illustrated in section to show the details of construction.
Figure 9:
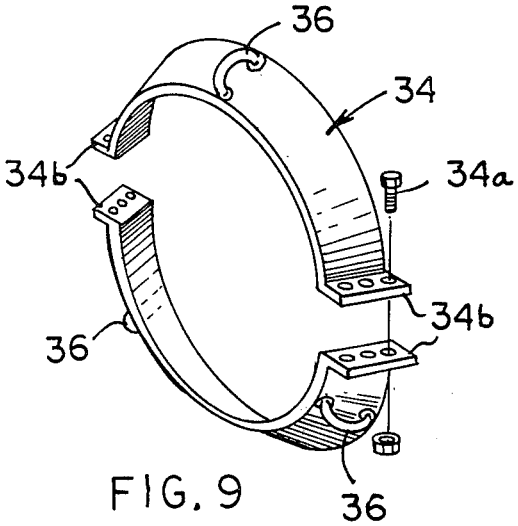
FIG. 9 is a perspective view of one of the rings.

Referring now to the drawings, a sailing vessel according to the present invention is illustrated. The frame 14 of the vessel comprises four rigid spars 16, 18, 20 and 22, which are connected at a juncture 24, as illustrated in detail in FIG. 10 in a tetrahedral shape at approximately 110° angles relative to each other. The construction of spars 16–22 is illustrated in FIGS. 8 and 9, and will be seen to comprise a solid core 26 of a phenolic structural foam wrapped with glass filaments 28 impregnated within a medium of polyester resin. The glass filaments 28 are wrapped in two or more overlapping layers wherein adjacent layers are wrapped at angles of 90° relative to each other with the angle of wrap being at a 45° angle relative to the longitudinal axis of the spar. Although it is believed that this construction will provide the necessary compressive strength for spars 16–22, other constructions may be feasible also, and the present invention is not limited to the specific construction illustrated.

In order to provide connection between the stays, such as stay 32, and the spars 16–22, conical, stainless steel rings 34 are firmly fitted around conical bulges 35, which are, in effect, built up portions of spars 16–22 (FIGS. 8 and 9). Rings 34 are formed in two pieces and fastened together by means of bolts **34*a* which connect flange portions 34*b*. This arrangement permits easy removal and replacement of rings 34, and the conical shape of bulges 35 and rings 34 provides a secure rigid connection, which prevents slippage caused by tension of the stays. As will be noted, the forces exerted on spars 16–22 by the stays tends to pull rings 34 against bulges 35. As shown in FIGS. 8 and 9, the conical rings 34 include a plurality of stainless steel, semicircular eyes 36, which are integral therewith, welded thereto, or attached in any other suitable fashion. The stays 32, which are preferably stainless steel cable of suitable size, may be connected to eyes 36 by clevises (not shown), rings (not shown), of by doubling back the end of the stay so as to form a loop portion 40 and then whipping the free end 42 of the stay 32 back on itself as illustrated in FIG. 8. Other suitable means for connecting these stays 32 to spars 16** may also be employed without departing from the scope of the present invention.

Referring now to FIGS. 1–5, it will be seen that the spars 16–22, which are of equal lengths, are retained in the tetrahedral configuration by means of a plurality of stays, similar to stay 32 shown in FIG. 8. In all cases, the stays are connected to the spars 16–22 by the rings 34 shown in FIGS. 8 and 9.

The triangular base of the frame 14 is formed by interconnecting the ends 44 of spars 16, 18 and 20 by stays 46, 48 and 50. Stays 52, 54 and 55 are connected between the ends 44 of spars 16, 18 and 20 to the end 44 of vertical spar 22. It is important to note that the points at which stays 46–55 are connected to spars 16, 18, 20 and 22 are equidistant from the juncture 24, and that each of the stays 46–55 are of equal length. This arrangement ensures that the static loads for each of the like structural members, including stays 46–55 and spars 16–22, will be equally distributed so as to result in an extremely rigid, strong structure capable of withstanding the heavy seas and high winds often encountered in trans-oceanic voyages.

In order to further stiffen the frame 14 and provide additional points of securement for the support members and for the sails to be described below, a system of parallel stays is provided. FIGS. 2–5 illustrate the arrangement of these stays in greater detail, which are numbered correspondingly to the main stays 46–55. For example, behind main stay 54 (FIG. 2) there are three parallel stays 54*a*, 54*b* and 54*c* connected between spars 16 and 22. Similarly, behind main stay 52 are parallel stays 52*a*, 52*b*, and 52*c* connected between spars 18 and 22. Stay 52*a* is equal in length to stay 54*a*, stay 52*b* is equal in length to stay 54*b*, and stay 52*c* is equal in length to stay 54*c*. The same is true with respect to each of the other main stays 46–55, wherein the stays defining each triangular sub-face of the tetrahedral frame are of equal length, and are connected to the spars 16–22 at points respectively equidistant from the juncture 24. Each of the connections between stays 46–55 and the corresponding inner stays is made by way of a ring 34 of the type shown in FIGS. 8 and 9.

Figure 10C:
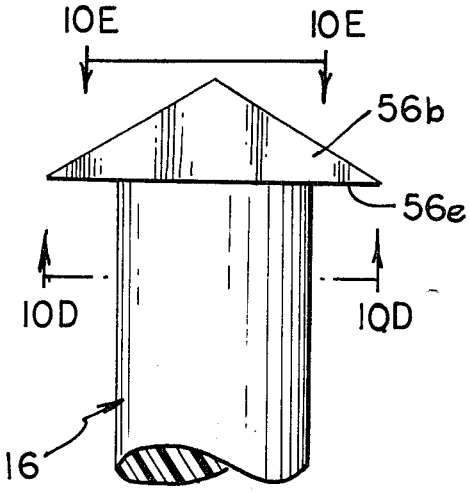
FIG. 10C is an isometric view of an end of one of the spars without fillets.
Figure 10E:
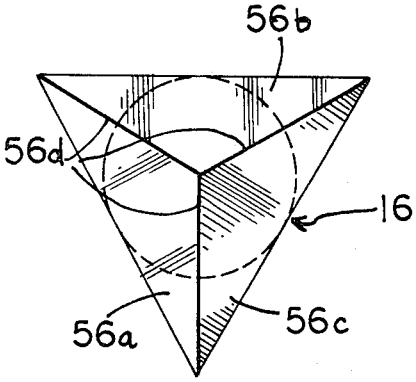
FIG. 10E is an end view along line 10E—10E of FIG. 10C.

The juncture 24 of spars 16–22 according to one embodiment of the invention is illustrated in detail in FIGS. 10, 10A, 10B, 10C, 10D and 10E. The structural foam cores 26 of spars 16–22 are molded such that they include integral enlarged end portions 56, 58, 60 and 62, respectively. The end portions are shaped as tetrahedrons each having three non-equilateral planar faces (denoted by corresponding numerals and the letters a, b and c) separated by three vertices 56*d*, 58*d*, 60*d* and 62*d*, and an equilateral triangular face 56*e*. Although not illustrated, the end portion of spars 18–22 would also have equilateral triangular faces similar to face 56*e*. As is illustrated in FIG. 10, the respective faces of the end portions 56, 58, 60 and 62 interfit with each other so as to form an equilateral tetrahedron.

FIGS. 10 and 10A illustrate the spar ends wherein fillets 63 provide smooth transition between the generally cylindrical portion 64 and the triangular outer face of end portion 56 are shown more clearly. The fillets 63 would be formed during molding and are integral with the cylindrical portion 64 and the enlarged end portion 56.

Since the ends of spars 16–22 are stressed compressionally due to the tensioning of stays 46–55, and there is an absence of shear along the inner planar faces of the end portions 56, 58, 60 and 62, juncture 24 will remain intact. However, it is desirable to provide some sort of retaining device to prevent the spars 16–22 from falling apart at the juncture 24 should, for example, one of the stays 46–55 break. FIG. 10B illustrates an examplary innerconnection scheme which is seen to comprise eyes 66 secured to end portions 56, 58 and 62, and three rings 68, which are interconnected with each other and with respective eyes 66. A similar interconnection assembly is provided at each of the other vertices of juncture 24, although they have not been shown for the sake of clarity. Alternatively, the four end pieces could be fused together along their shearless inner planar faces, making the juncture one solid piece.

Figure 7:
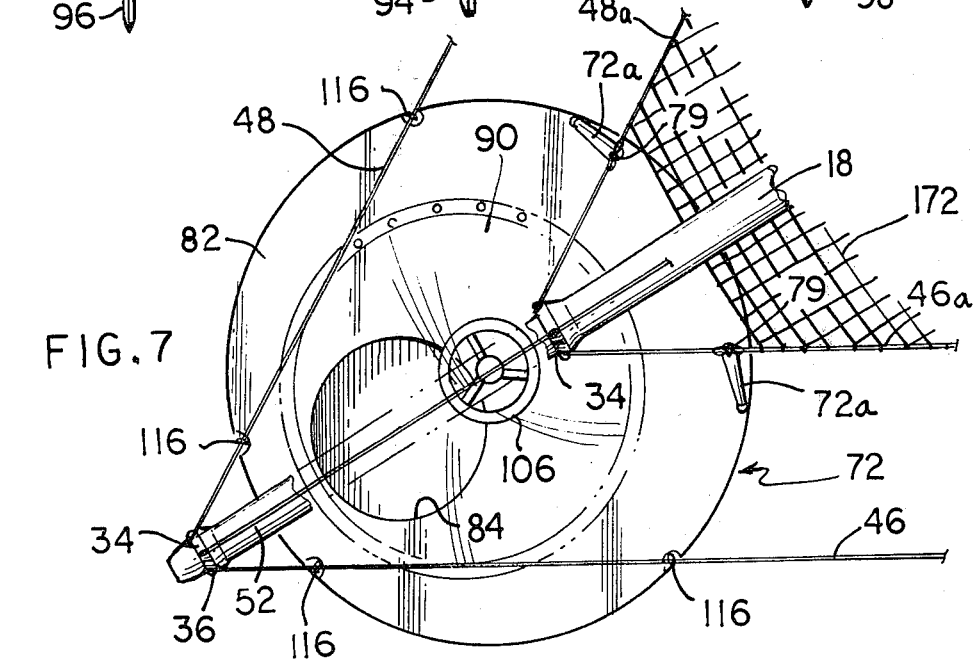
FIG. 7 is a plan view of the support members shown in FIG. 6.

In order to support the vessel on the surface of the water, three support members 72, 74 and 76 are provided. With particular reference to FIGS. 1, 6 and 7, it will be seen that the support members 72, 74 and 76 are connected by eye bolts 116 to stays 46, 48 and 50, which connect the distal ends of spars 16, 18 and 20. Each support member 72, 74 and 76 is additionally retained by two spars 72*a*, 74*a* and 76*a*, which are connected to the converging inner stays 46*a*, 48*a* and 50*a* by interconnected eye 81 and rings 79. The lower ends of spars 72*a*, 74*a* and 76*a* are secured to the upper decks 82 of support members 72, 74 and 76 by ball and socket joints 77. Thus, support members 72, 74 and 76 are held in tension by stays 46, 48 and 50, and are held against vertical rocking movement by spars 77.

Each of the support members 72, 74 and 76 is formed as a hollow, shell-like enclosure having a curved sidewall 80, a slightly curved upper surface 82 adapted to shed water, and an opening 84 in the top 82 of sufficient size to permit ingress and egress of a crew member. The bottom surface 86 of each of the support members 72, 74 and 76 is curved so as to function as a planing surface that will cause the vessel to ride higher on the surface of the water 88 when the boat reaches a certain speed (FIG. 6). Each support member 72, 74 and 76 is symmetrical about a vertical axis extending through the center thereof. If desired to enclose the support members 72, 74 and 76, a plastic cover 90 may be secured to deck 82, as by snaps, over opening 84. In fair weather, it is anticipated that cover 90 will not be needed, however, it would be necessary in the event of inclement weather so as to prevent the interior 92 of the support members 72, 74 and 76 from filling with water.

It is intended that the support members 72, 74 and 76 be sufficiently buoyant to permit the vessel to float at the level generally indicated in FIG. 6. If room within the support members 72, 74 and 76 permits, however, it would be desirable to include flotation material, such as styrofoam. Each of the support members 72, 74 and 76 is intended to be sufficiently large to permit a crew member to be received therein, or to store cargo.

In order to control the orientation and heading of the vessel, movable rudders 94, 96 and 98 are connected to and extend downwardly from the support members 72, 74 and 76, respectively. Rudders 94, 96 and 98 are preferably blade-shaped and have a relatively large aspect ratio as illustrated in the drawings. An exemplary arrangement for mounting rudders 94, 96 and 98 is illustrated in FIG. 6 and will be seen to comprise a column 100, which additionally provides reinforcement to the support members 72, 74 and 76, within which a vertical shaft 102 is rotatably received. Column 100 may be made of steel or plastic and molded with the support members 72, 74 and 76 as a preform, to form a torus as illustrated in FIG. 6. Shaft 102 is connected to an external steering wheel 106, and is adapted to be turned by the crew member positioned within the respective support member 72, 74 and 76. The mounting and control assembly for each of the rudders 94, 96 and 98 is identical to that shown in FIG. 6, thereby enabling them to be controlled independently of one another, if desired. Alternatively, two or more of the rudders 94, 96 and 98 could be controlled in unison by means of control cables and pulleys in much the same manner as small power boats are controlled.

Figure 2:
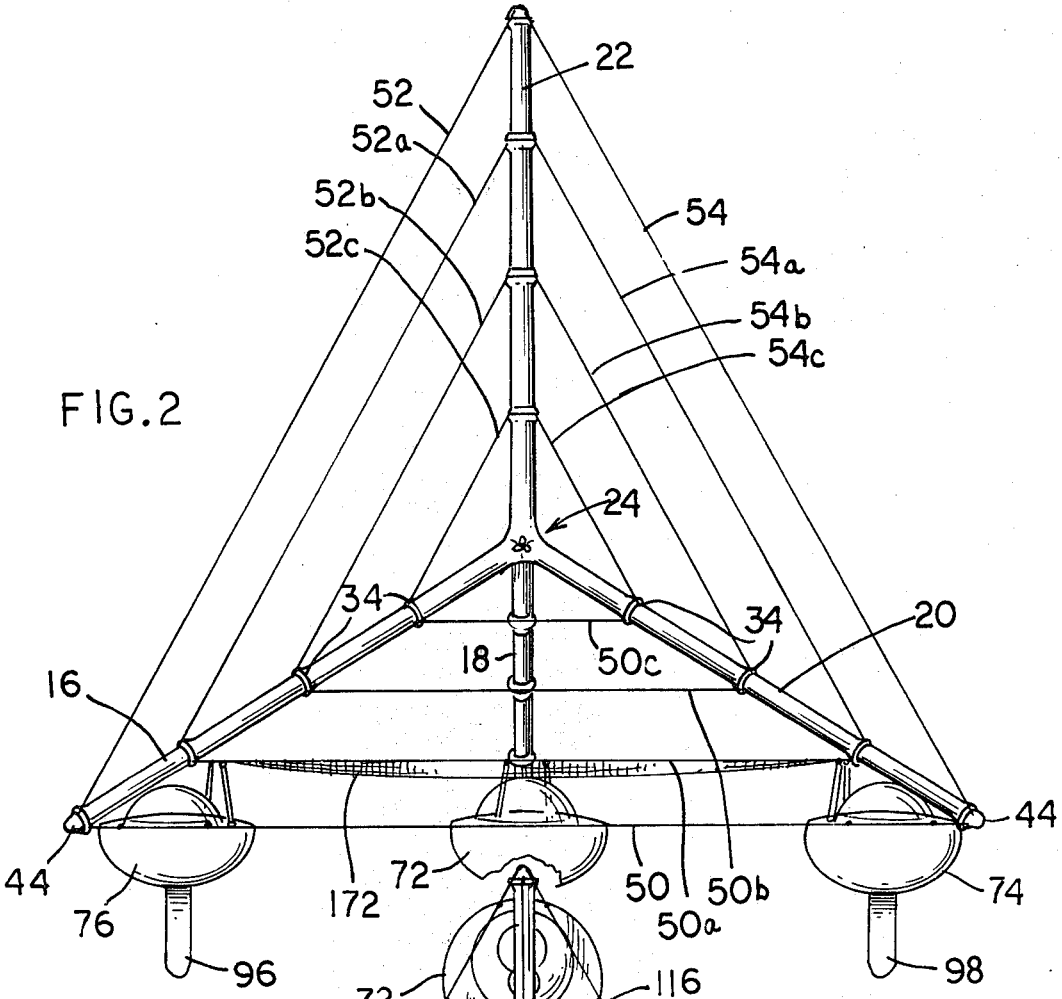
FIG. 2 is a front elevational view thereof with the sails removed.
Figure 3:
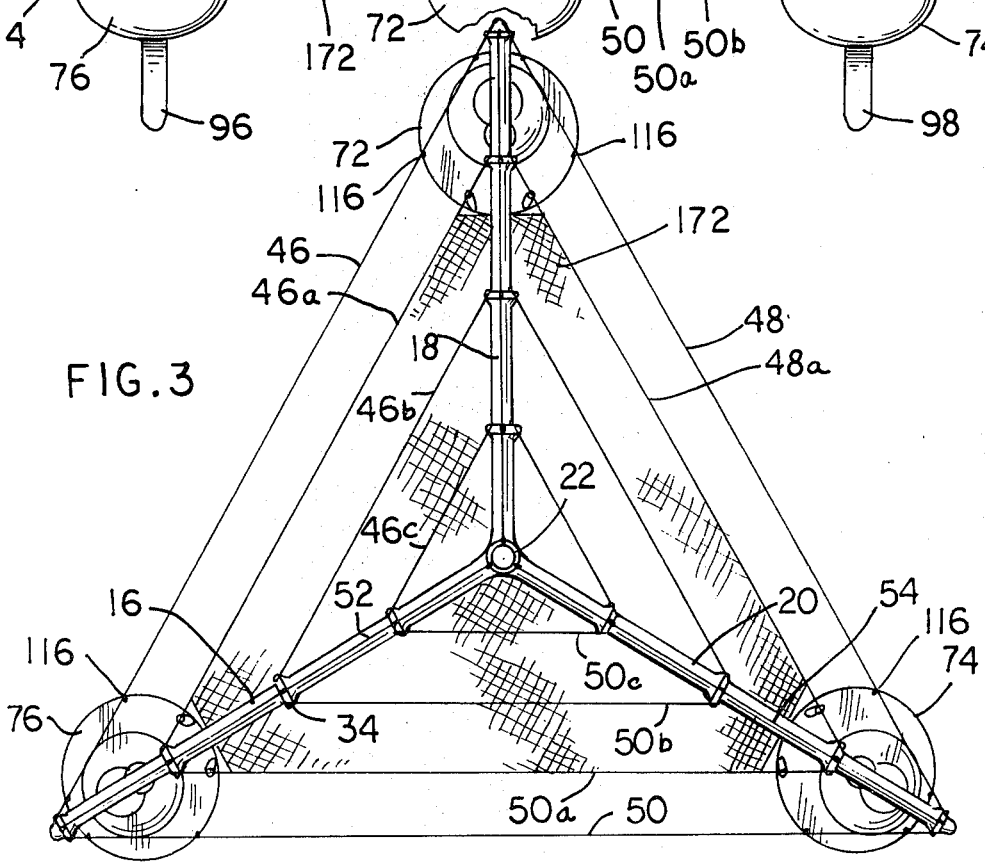
FIG. 3 is a plan view thereof with the sails removed.
Figure 4:
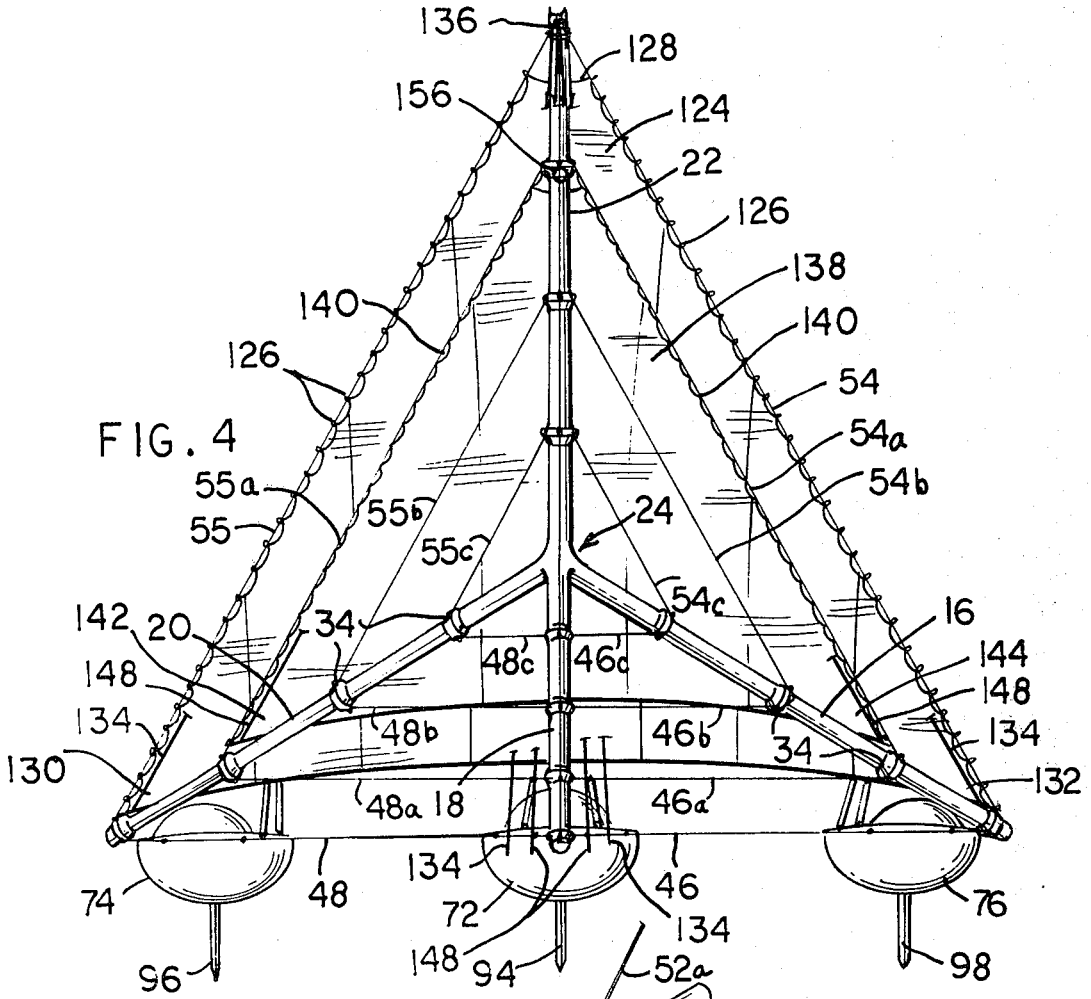
FIG. 4 is a rear elevational view thereof with the rear sails removed.
Figure 5:
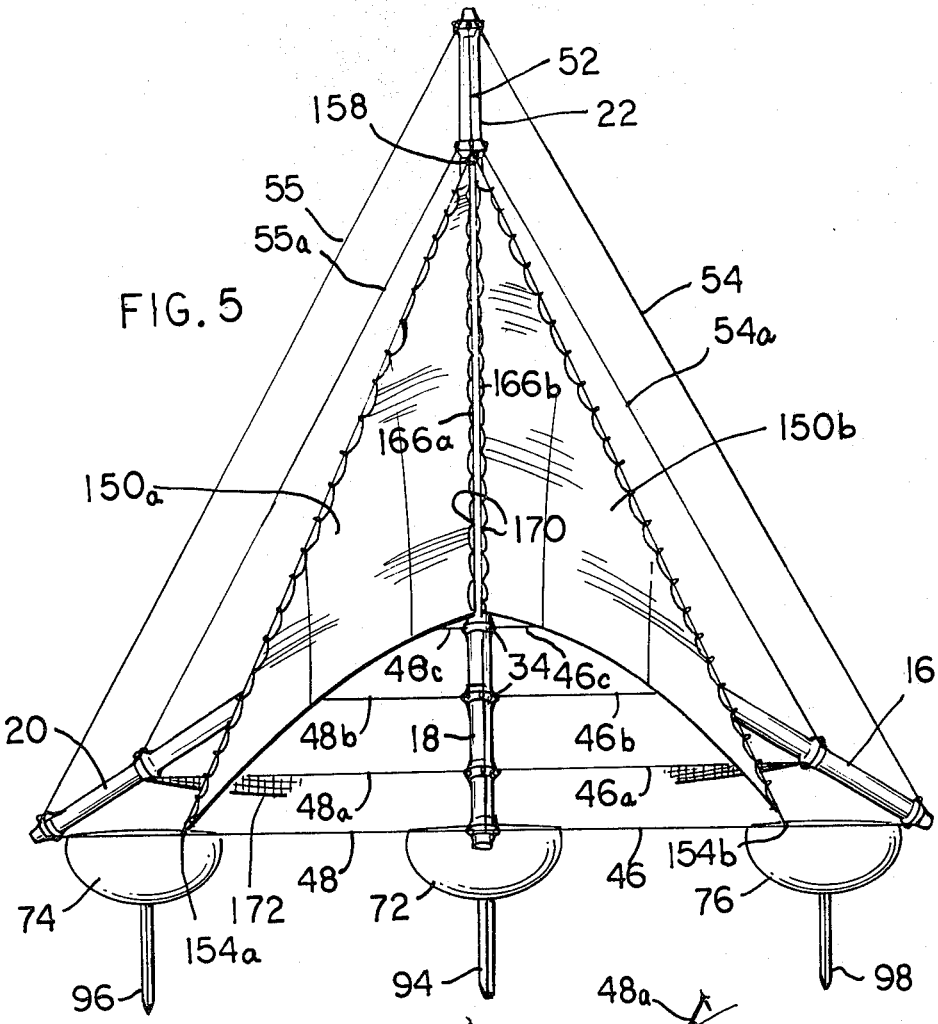
FIG. 5 is a rear elevational view thereof with the rear sails shown.

With reference now to FIGS. 1, 4 and 5, the sail arrangement and a means for supporting the sails will be described. The largest mainsail 124 is generally triangular in shape and is connected to stays 54 and 55 by means of standard sailing clevises 126, which are sewn or otherwise secured to the sail 124 and then the loop or clip portions thereof secured over stays 54 and 55. It should be noted that sail 124 is only generally triangular in that the apex edge 128 thereof does not come to an absolute point. The lower corners 130 and 132 may be tied, clipped or otherwise secured to spars 16 and 20 so that the sail 124 will not be inadvertently raised by the wind. In order to raise sail 124, two halyards 134 are connected to the lower corners 130 and 132, guided over a pulley assembly 136, and extended downwardly to the rear support member 72 as illustrated in FIG. 4. Thus, to raise the sail 124, it is merely necessary to pull in halyards 134 thereby causing the lower edge of sail 124 to be pulled upwardly and slide along stays 54 and 55 until it is bunched up at the top of vertical spar 22. In order to assist in lowering (furling) sail 124, a continuous loop arrangement may be utilized similarly to that used in hoisting and lowering flags on a conventional flagpole.

Generally parallel to and positioned behind the large mainsail 124 is a smaller mainsail 138, which is connected to stays 54*a* and 55*a* by clevises 140 in an identical manner as the large mainsail 124. The lower corners 142 and 144 of the generally triangular secondary mainsail 138 may be clipped or otherwise secured to the next inward rings 34 of spars 16 and 20. To raise sail 138, halyards 148 connected to the lower corners 142 and 144 are guided through pulley system 136 and down to the rear support member 72.

FIGS. 1 and 5 illustrate the rear auxiliary sails 150*a*, 150*b* and 152*a*, 152*b*. Sails 150*a* and 152*a* are generally triangular in shape and are secured to stay 48 by means of fixed location, releasable clevises 154*a* and 162*a*, to rings 34 on spar 18 at their lower inside corners, and to a spar 156 and stay 52 by means of clevise 158 at their upper corners. Spar 156 is means of clevise 158 at their upper corners. Spar 156 is connected by means of rings or clevises to stay 52 and vertical spar 22.

Sails 150*b* and 152*b* are connected to stay 46 at their lower outside corners by means of fixed location, releasable clevises 154*b* and 162*b*, to rings 34 on spar 18 at their inside lower corners, and to spar 156 at their upper corners by clevises 158. In order to furl sails 150*a*, 150*b* and 152*a*, 152*b*, clevises 154*a*, 154*b* and 162*a*, 162*b* are released and the sails are pulled in and wrapped around vertical stays 164*a*, 164*b* and 166*a*, 166*b*, which are connected between spar 18 and spar 156. The inner edges of sails 150*a*, 150*b* and 152*a*, 152*b* are connected to stays 164*a*, 164*b* and 166*a*, 166*b* by means of clevises 170.

If desired, a net or canvas trampoline 172 may be suspended between stays 46*a*, 48*a* and 50*a*, thereby permitting the occupants of the vessel to move from one support member to the other.

In order to navigate the vessel, the forward two rudders 96 and 98 are preferably controlled in parallel, and the vessel will follow the heading defined by the orientation of these rudders 96 and 98. In order to turn the vessel, the rear rudder 94 is temporarily turned to an orientation which is not parallel with the orientation of rudders 96 and 98 and, once the vessel has turned to the desired new orientation, rudder 94 is again brought back in line with rudders 96 and 98. Thus, runs, reaches and beating to windward can be accomplished with the vessel by orientating the vessel in the desired manner relative to the direction of the wind. Although a very simple control mechanism comprising wheels 106 has been illustrated, long ocean voyages would probably dictate the use of some sort of automatic pilot for maintaining the forward rudders 96 and 98 in the proper orientation for the desired heading. If control from a single support member 72, 74 or 76 is desired, control cables similar to those used in connection with small water craft, could be connected to the steering wheels 106 and strung between the support members 72, 74 or 76.

It is anticipated that the vessel described above could be employed for hauling cargo on trans-oceanic voyages, and could have a very large diameter, for example, several hundred feet. FIG. 11 illustrates schematically the vessel configured for towing cargo pods 174, 176 and 178. Pod 178 is designated as the control pod, and may include an occupant, whereas pods 174 and 176 are strictly for the purpose of containing cargo.

The freight or cargo pods 174 and 176 can be constructed along unrestricted lines to meet the anticipated needs for handling specific types and quantities of cargo. The control pod 178, however, is required to control the direction of translational movement of the cargo pods 174 and 176 and the vessel. The direction of movement is controlled by a rotatable centerboard (not shown) rotatable about a vertical axis and attached to the control pod 178. The centerboard produces the necessary side force to produce the desired direction of movement. The control pod can be uncovered so as to accommodate crew members, whereas pods 174 and 176 are covered so as to protect the cargo. Pod 176 is connected to pod 178 by cable 180, and pod 174 is connected to pod 176 by cable 182. If desired, any number of additional pods could be connected in line in a similar fashion.

In this configuration, neither rudders nor centerboards are required on support members 72, 74 and 76, since orientation of the vehicle is controlled by lines 184, 185 and 186, which are connected to the center of the top surface of control pod 178 and to the distal ends of the three lower spars. By pulling in cable 186, for example, the vessel will be oriented to the left. Similarly, the vessel can be turned to the right by shortening cable 184. Additional maneuverability of the vessel may be obtained by attaching small outboard motors to the support members 72, 74 and 76.

Rather than constructing spars 16–22, 72*a*, 74*a*, 76*a* and 156 as described above, they could be formed of tensegrity masts (not shown) constructed of a plurality of linearly arranged basic tetrahedral units of the shape defined by spars 16–22 and stays 46–55. Each of the tensegrity masts would extend outwardly from the juncture 24, and the juncture itself would be formed as a single tetrahedral unit having the desired four directions of extension. An extensive discussion of tensegrity masts is set forth in *Bucky: A Guided Tour of Buckminster Fuller* by Hugh Kenner.

Although the present invention is not limited to a particular size, the vessel should approximate the following mensuration formulae:

Length of spars 16–22 = L

Length of outer stays 46–55 = $\frac{2}{3}\sqrt{6}\,L$

Angle between adjacent struts = $\mathrm{Cos}^{-1}(-\frac{1}{3})$

Angle between adjacent cables = 60°

Angle between struts and adjacent cables = $\mathrm{Cos}^{-1}\,2/\sqrt{6}$

Elevation angle of base struts 16, 18 and 20 = $\mathrm{Sin}^{-1}(\frac{1}{3})$ Height of frame 14 = 4 L/3

Figure 12:
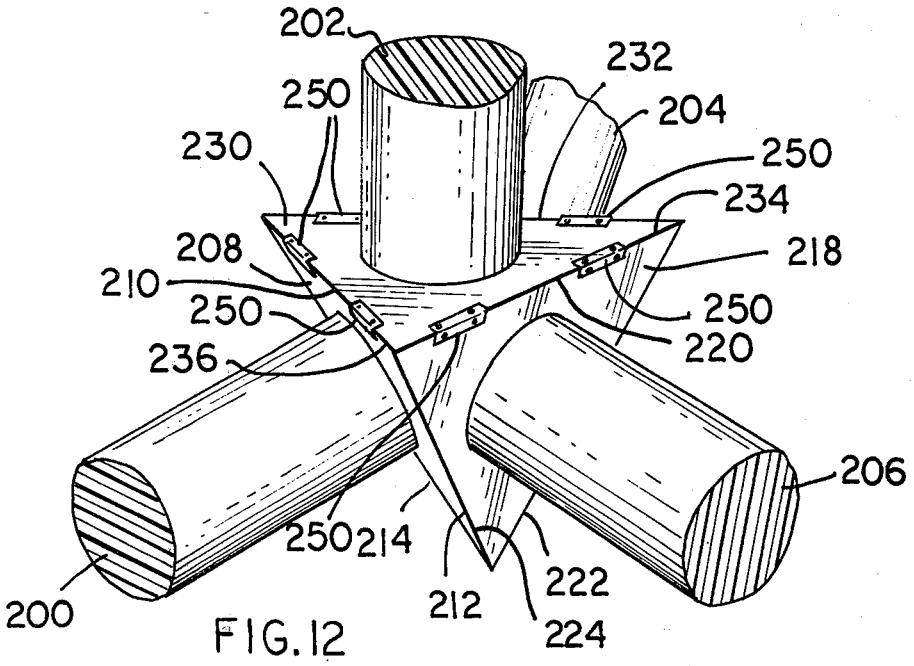
FIG. 12 is an enlarged perspective view of a modified form of the juncture.
Figure 13:
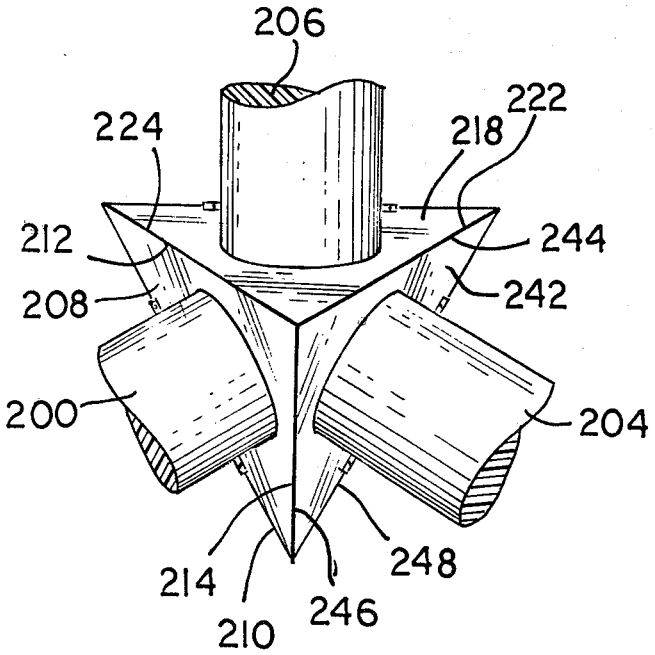
FIG. 13 is a bottom view of the juncture of FIG. 12.
Figure 14:
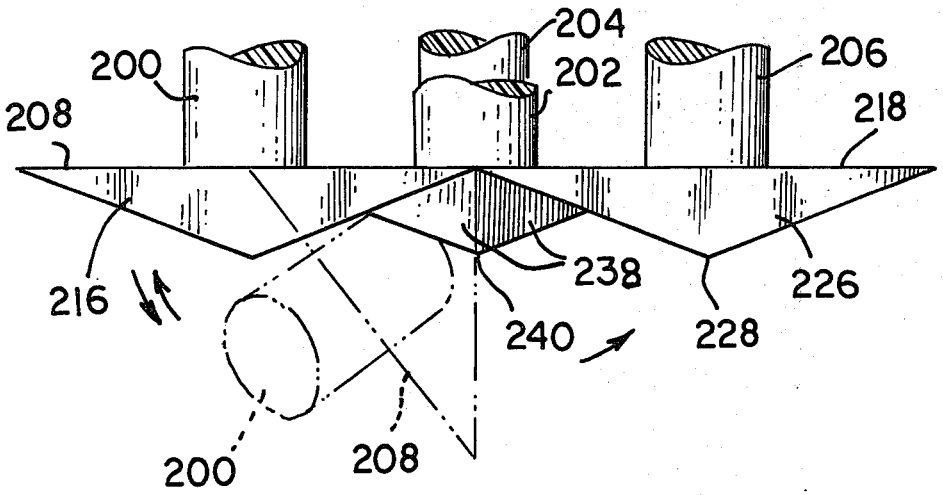
FIG. 14 is an elevational view of the modified juncture in its completely open and collapsed state, wherein the closed position of one of the spars is indicated in dot-dash lines.

A modified form of the juncture is illustrated in FIGS. 12–15 wherein the spars 200, 202, 204 and 206 are hingedly connected together so as to permit the frame to be collapsed when cetain of the main stays connecting the spars 200, 202, 204 and 206 are released or relaxed. Specifically, the end portion of spar 200 comprises an equilateral triangular face 208 having three coplanar vertices 210, 212 and 214, and three triangular faces 216, one of which is shown in FIG. 14. Spar 206 also comprises an equilateral triangular face 218 and three vertices 220, 222 and 224, wherein vertex 224 is immediately adjacent vertex 212 of spar 200. Spar 206 includes three triangular faces 226, one of which is illustrated in FIG. 14, which join at apex 228. Spar 202 comprises an equilateral triangular face 230 and vertices 232, 234 and 236. As shown, vertex 234 is closely adjacent vertex 220 of spar 206, and vertex 236 is adjacent vertex 210 of spar 200. Spar 202 comprises three triangular faces 238, two of which are shown in FIG. 14, which converge at apex 240. Spar 204 comprises equilateral triangular face 242 and vertices 244, 246 and 248, wherein vertex 244 is adjacent vertex 222 of spar 206, vertex 246 is adjacent vertex 214 of spar 200, and vertex 248 is adjacent vertex 232 of spar 202. Although not shown, spar 202 comprises three triangular faces similar to the faces 216, 226 and 238 of spars 200, 206 and 202, respectively.

Spars 200, 204 and 206 are connected to spar 202 by means of hinges 250 connected to the respective equilateral faces 208, 230, 242 and 218 of spars 200, 202, 204 and 206, respectively. This arrangement permits spars 200, 204 and 206 to articulate about the vertices 210, 232 and 234 of spar 202. When fully opened, as illustrated in FIG. 14, each of the shank portions of the spars 200, 202, 204 and 206 are parallel and extend in the same direction, and the end portions form a somewhat flattened shape with their equilateral triangular surfaces 208, 230, 218 and 242 being coplanar.

This system is sufficient to ensure that the four interfitted end pieces remain together and intact at the juncture when the spars 200, 202, 204 and 206 extending from the juncture are held in place by the main and parallel stays connected between the spars. This is because there are substantially no shear forces on the abutting faces of the spar end portions when the stays are in place. When certain of the main and parallel stays are released or relaxed, however, the structure is permitted to collapse, and the hinged connections between the spars 200, 202, 204 and 206 which permit the spars 200, 204 and 206 to articulate about spar 202 enables the tetrahedral frame to collapse. This is advantageous from the standpoint of being able to store the collapsed frame structure in a space of reduced volume. Furthermore, transport of the craft is greatly facilitated.

Figure 15:
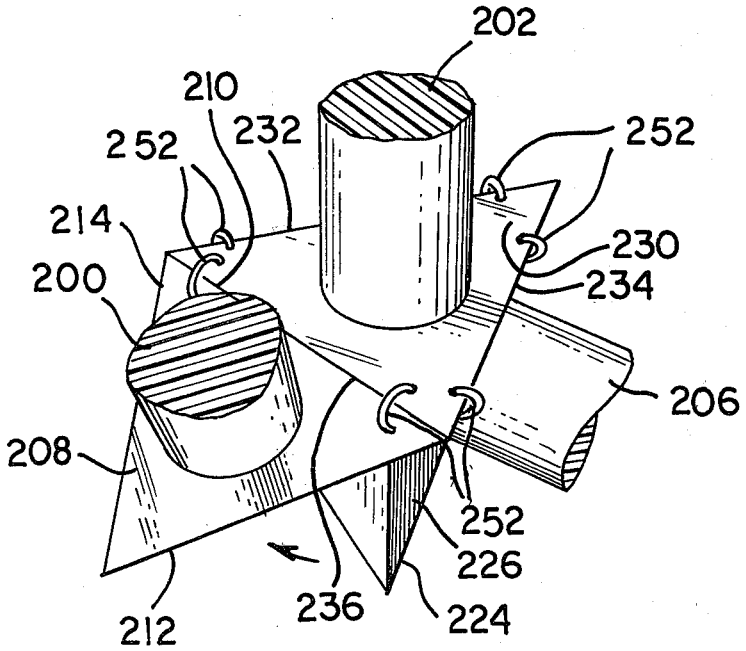
FIG. 15 is a perspective view of a further modification to the spar juncture in a partially collapsed state.

FIG. 15 illustrates a further modified form of the juncture of FIGS. 12–14 wherein stainless steel rings 252, loop through openings in the equilateral faces 208, 230, 218 and 242 of the spars, and function to hingedly connect the spars together in much the same manner as in the embodiment of FIGS. 12–14. Spars 200, 202, 204 and 206 could also be connected together for articulation by means of other suitable mechanisms in addition to the hinge and ring arrangements illustrated.

Not only is the vessel heretofore described suitable for a water vessel, but could also be adapted for movement over ice by replacing the support members 72, 74 and 76 with blades or ski-like runners. Furthermore, the vessel could be designed for travel over land by replacing the support elements 72, 74 and 76 with support wheels.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A wind propelled craft adapted to move over a surface comprising:

three substantially equidistantly spaced support members adapted to engage and be supported on the surface, four substantially rigid spars connected together at a juncture and extending radially outward therefrom, each of said spars forming an angle of about 110° with each of the other spars, said spars having ends distal from the juncture, a plurality of substantially equilength stays connected to and between each one of said spars and the other spars, respectively, said stays being connected to said spars at points substantially equidistant from said juncture so as to form with said spars a frame of substantially equilateral tetrahedral shape, one end of each of said spars being formed as three faces of a tetrahedron, wherein said three faces converge at an apex and wherein the faces of the spars at the juncture interfit with each other to form a generally solid assembly at the juncture, means for movably connecting three of said one ends to the fourth said one end so that said three ends can articulate about said fourth end when certain of said stays are disconnected from the spars, three of said spars extending generally laterally and downwardly from the juncture and the fourth spar extending vertically upward from the juncture, said support members being connected to said frame at points near the distal ends of the spars extending laterally and downwardly from the juncture, and a sail connected to said frame.

2. The craft of claim 1 wherein each of said three ends includes three externally facing edges adjacent three respective externally facing edges of said fourth end, and said means for movably connecting comprises hinge means connecting said adjacent edges together.

3. The craft of claim 2 wherein said hinge means comprises rings passing through said fourth end and each of said three ends in the vicinity of the adjacent edges.

4. The craft of claim 1 wherein said ends form a generally tetrahedral assembly at said juncture.

* * * * *